US006985682B2

(12) United States Patent
Haines et al.

(10) Patent No.: US 6,985,682 B2
(45) Date of Patent: Jan. 10, 2006

(54) MEDIA IDENTIFICATION SHEET

(75) Inventors: Robert B. Haines, Boise, ID (US); Judith A. Garzolini, Star, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 865 days.

(21) Appl. No.: 09/981,265

(22) Filed: Oct. 17, 2001

(65) Prior Publication Data

US 2003/0095810 A1 May 22, 2003

(51) Int. Cl.
*G03G 15/00* (2006.01)

(52) U.S. Cl. ..... 399/84; 399/82

(58) Field of Classification Search ..... 399/23, 399/38, 66, 75, 82, 84, 389, 391; 250/559.44
See application file for complete search history.

(56) References Cited

U.S. PATENT DOCUMENTS 4,248,528 A * 2/1981 Sahay ..... 399/84
4,847,656 A * 7/1989 Kuno et al. ..... 399/84
4,987,447 A * 1/1991 Ojha ..... 399/84
5,051,779 A * 9/1991 Hikawa ..... 399/84
5,247,371 A * 9/1993 Hikawa et al. ..... 399/84 X
5,521,674 A * 5/1996 Guillory et al. ..... 399/66
5,729,350 A * 3/1998 Ozaki ..... 399/84 X
5,774,146 A * 6/1998 Mizutani ..... 347/43
6,028,320 A * 2/2000 Uhling ..... 250/559.44
6,047,110 A 4/2000 Smith ..... 395/111
6,107,920 A 8/2000 Eberhardt et al. ..... 340/572.7
6,148,162 A 11/2000 Huston et al. ..... 399/66
6,255,665 B1 * 7/2001 Elgee et al. ..... 250/559.44 X

* cited by examiner

*Primary Examiner*—Sandra L. Brase

(57) ABSTRACT

Arrangements and procedures are described to automatically configure an imaging device to form images on sheets of print media in a stack of print media. To accomplish this, information is imprinted on the top sheet of the stack of print media. The information provides media parameter information that corresponds to each of the other sheets of print media in the stack of print media. An imaging device senses, or reads the information from the top sheet in a manner that is independent of any particular orientation of the top sheet. The imaging device is configured form images on each of the sheets of print media based on the sensed information.

25 Claims, 7 Drawing Sheets

MEDIA IDENTIFICATION SHEET

TECHNICAL FIELD

The described arrangements and procedures relate to optimizing imaging device operations based on print media information.

BACKGROUND

Conventional imaging devices such as printers, plotters, copiers, facsimile machines and the like, typically utilize various types of print media to print images. Such print media types include paper based media (e.g., glossy paper, semi-glossy paper, matte paper, etc.) as well as non-paper based media (e.g., vellum, film, etc.).

To optimize print quality, an imaging device generally requires a number of parameters such as print modes, color maps, and so on, to be configured. This is because such parameters typically vary with the type of media being utilized. For example, an ink-based imaging device such as an ink jet printer that prints to an overhead transparency (OHT) designed for a laser printer may result in a print that not only may need to re-imaged, but that also may result in gumming-up the internal assembly of the imaging device. This is because ink-based imaging devices use ink and laser-based OHTs do not generally have any ink retention coating. Accordingly, an ink-imaging device may adjust parameters such as printing speed, ink drying time, the amount of ink used, etc., to suit the particular print media being used.

In yet another example, a laser-based imaging device such as a laser printer that prints on an ink-based OHT may melt the ink-based OHT because ink-based OHTs are not manufactured to withstand the amount of heat typically generated by a laser printer's image fusing process. As a result, the imaging job may not only need to be re-imaged, but the job may also result in the need to replace printer parts if the incompatible print media melted onto internal parts of the laser printer. Accordingly, a laser-imaging device may adjust parameters such as the speed of printing, ink-fusing temperature, biasing voltage, etc., to suit the particular print media being used.

Some imaging devices need to be manually configured to properly operate based on the print media type that is going to be used. Thus, print media type information and instructions are typically written on a media box. However, many users do not read the box or the instructions that accompany the media. If the user re-installs the print media on another printer, the user is often required to either remember or guess the media type. This is because once the user removes the media from the box for installation into the device, the box is generally thrown away, and the media data type and/or other instructions are often lost.

Accordingly, a number of conventional techniques have been developed for an imaging device to identify the particular type of print media that is loaded into an imaging device. For example, U.S. Pat. No. 7,148,162 to Huston et al., assigned to the assignee hereof, and incorporated herein by reference, describes marking each sheet of print media with eight separate indicia by imprinting the markings either on the face of each media sheet or on the side of each media sheet. E.g., two (2) barcodes are printed on each margin on a face of a sheet of print media, or 2 barcodes are printed on each edge of a sheet of media—top, right, bottom and left.

Such a conventional procedure to provide print media parameters to a printer has a number of disadvantages. One disadvantage, for example, is that print media marking costs can be substantially increased by the requirement to mark each sheet of print media with eight separate barcodes. An additional disadvantage is that up to eight separate sensors (e.g., optical sensors) are required to sense the sheet's eight markings—one dedicated sensor per marking. Requiring so many sensors generally increases printer fabrication costs. A further disadvantage is that such a procedure does not typically provide a way for the printing device to determine the quantity of print media that is loaded into the tray because each sheet is sensed individually. Thus, a user may not be able to easily determine if the printer has enough print media loaded into the tray to complete a print job.

Accordingly, the various implementations of the following described subject matter address these and other problems of conventional techniques to provide print media parameters to printing devices.

SUMMARY

Arrangements and procedures are described to automatically configure an imaging device to form images on sheets of print media in a stack of print media. To accomplish this, information is imprinted on the top sheet of the stack of print media. The information provides media parameter information that corresponds to each of the other sheets of print media in the stack of print media. An imaging device can sense or read the information from the top sheet. The imaging device configures itself based on the sensed information to form images on each of the sheets of print media.

DETAILED DESCRIPTION

Overview

A single media identification (ID) barcode sheet having media parameter information imprinted thereon is placed on top of a stack of print media. The imprinted information is sensed, or read by the imaging device in a manner that is independent of orientation of the top sheet before the device forms any images on the other sheets in the stack. The imaging device uses this sensed information to configure its image forming parameters to form images on the remaining print media in the stack.

Arrangements and procedures that utilize a single media parameter sheet to convey operating parameters to an imaging device are beneficial for a number of reasons. For instance, print media upon which an image is to be formed are not marked in a fashion (e.g., marked with imprinted barcodes) that may impact print quality. This is because only the top sheet of a stack of print media is imprinted with the information, not each of the other sheets in the stack. Additionally, because only a single sheet in the stack is imprinted with information, rather than imprinting information on each sheet in the stack, the described arrangements and procedures provide a relatively inexpensive way to present media parameters to an imaging device such as a printer, copier, facsimile, and so on.

Another benefit is that third party manufactures of print media such as letterheads, blank checks, forms, and so on, can use the following described media identification barcode sheet to provide customized information to consumers of their products.

An Exemplary Image Forming System

Figure 1:
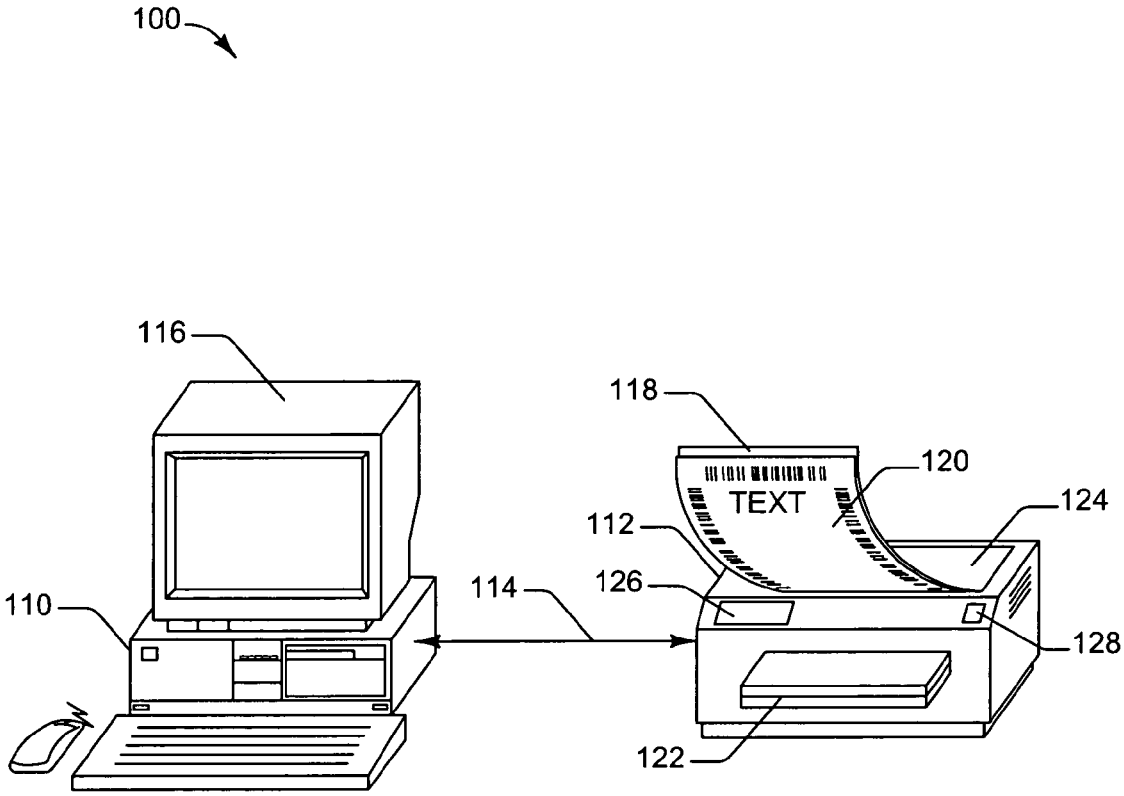
FIG. 1 shows exemplary image forming system.

FIG. 1 shows an exemplary image forming system 100, which includes a host device 110, an image-forming device 112, and a communication medium 114 operatively coupling the host device to the imaging device. The host device is implemented as a personal computer (PC), server, Web Server, or other device configured to communicate with image forming devices. The host device optionally includes a display 116 such as a CRT or flat-panel monitor to display information to a user.

An exemplary communication medium 114 includes a parallel connection, packet switched network, such as an intranet network (e.g., an Ethernet arrangement), and/or Internet, and other communication configurations operable to provide electronic exchange of information between the host device 110 and the image forming device 112 using an appropriate protocol. Other image forming system arrangements are possible including additional host devices and/or additional image forming devices coupled to the communication medium.

The image forming device 112 is configured to form images upon print media 118. One exemplary image-forming device is a printer, such as a laser printer, inkjet printer, a dot matrix printer, a dry medium printer, or a plotter. The described subject matter is embodied within other image forming device configurations such as multiple function peripheral devices, copiers, facsimile machines, plotters, and so on. The imaging device includes one or more print media supply bins 122, or trays into which print media are loaded.

The imaging device 112 is arranged to form images upon the print media 118 including, for example, paper, envelopes, transparencies, labels, etc. Print media may be in a number of different forms such as a stack, or a ream of print media. (An exemplary stack of print media is described in greater detail below in reference to FIG. 6). Different types of print media have various weights, surface finishes, roughness, wicking properties, etc., which impact equality of images formed thereupon by the imaging device.

In this example, the print media 118 includes a media barcode ID sheet 120 that is in the output bin 124. Thus, the media ID sheet has already presented to the imaging device, a number of media parameters to configure the device's imaging operations. An exemplary media barcode identification sheet is described in greater detail below in reference to FIG. 4. An exemplary procedure for an imaging device to sense and configure its operating parameters based on media parameter information provided by a media ID barcode sheet is described in greater detail below in reference to FIG. 7.

An Exemplary Image Forming Device

Figure 2:
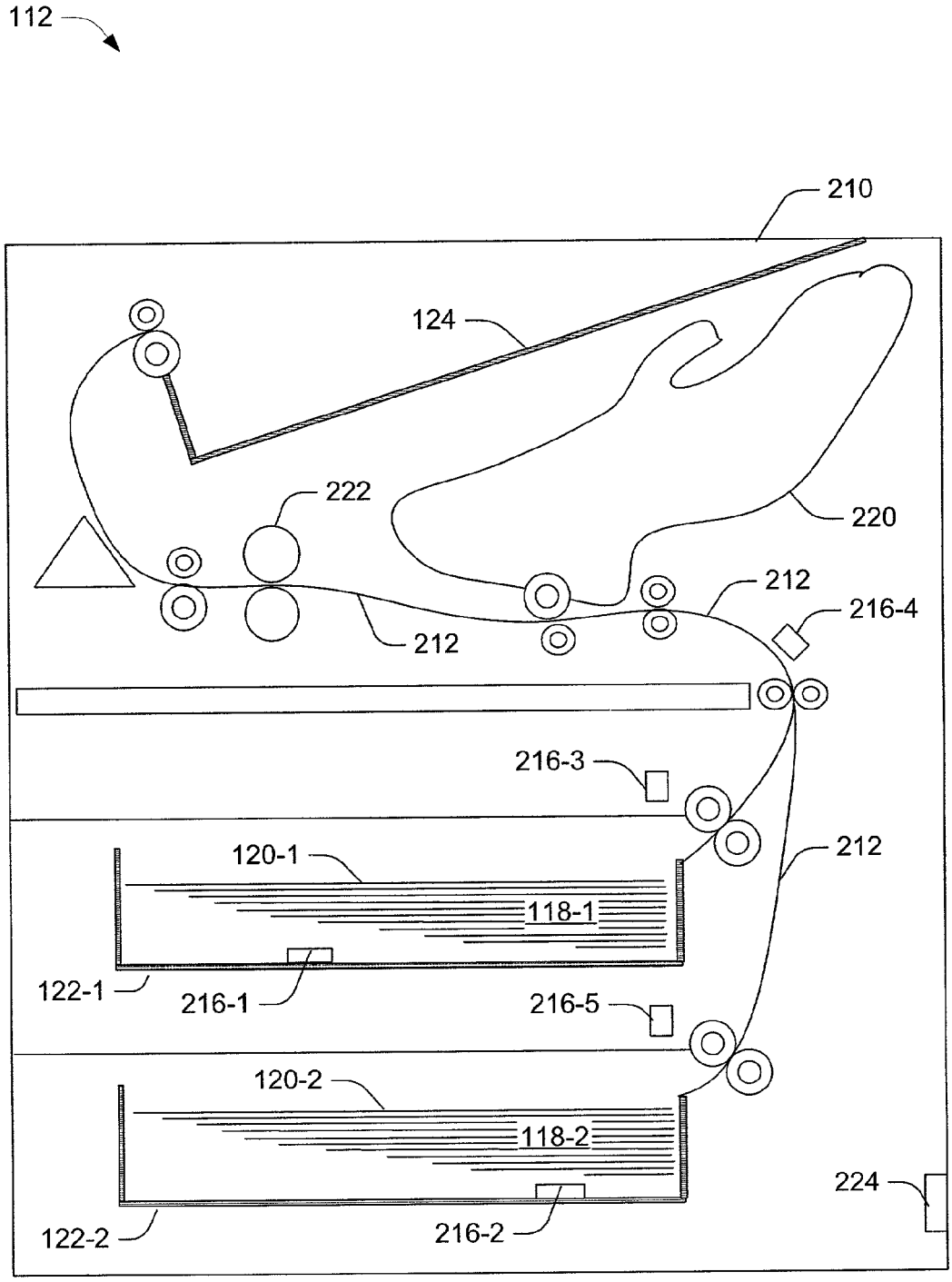
FIG. 2 shows further details of an exemplary arrangement of image forming device of the image forming system of FIG. 1.

FIG. 2 shows further details of an exemplary arrangement of image forming device 112. The image-forming device includes a housing 210 arranged to define a media path 212 to guide media within the housing. For example, a plurality of rollers is arranged within the housing to define the media path and to direct print media 118 from one or more media supplies 122 (e.g., media trays) to an output tray 124. In this configuration, the media is loaded sheet-by-sheet from the top of the stack by the rollers.

In the depicted arrangement, the device 112 includes a plurality of media supplies 122. A first and second media supply 122-1 and 122-2 include respective stacks, or reams of print media 118-1 and 118-2. Each stack has a respective single media barcode sheet 120-1 and 120-2 on the top of the stack of print media. Each respective media barcode information sheet has encoded data thereon that is used by the device 112 to substantially optimally configure itself to form images upon the print media. The encoded data stored on a media barcode identification sheet is read from media supplies 122 when the top sheet is picked from the stack and read by a sensor 216 that is described in further detail below.

The exemplary image-forming device 112 further includes an image engine 218 adjacent media path 212 and arranged to print or otherwise form images upon media 118. An exemplary image engine includes a print engine including a developing assembly 220 and a fusing assembly 222 in the depicted configuration. Control circuitry of the device is configured to control operations of device 112 including controlling operations of developing and fusing assemblies 220 and 222 as described in further detail below.

The image-forming device 112 includes one or more barcode sensors 216-1, 216-2, 216-3, 216-4 and 216-5 (e.g., an LED emitter detector pair) configured to read data encoded within markings, or indicia imprinted on a media barcode information sheet 120. Such indicia are positioned on the media barcode ID sheet such that they can be sensed from any orientation as long as a sensor is properly positioned to sense the indicia. For example, in this configuration, a media barcode ID sheet includes markings on the front, back, on each side, and on the top and bottom. (An exemplary media barcode information sheet is described in greater detail below in reference to FIGS. 4 and 6).

Accordingly, plural configurations of sensor 216 are possible. For example sensors can be positioned in the paper path 212 (e.g., sensors 216-3 and 216-4 are located along the media path), and/or adjacent to the media supply bin 122 (e.g., sensors 216-1 and 216-2). In this configuration, a sensor positioning in the paper path is optimal as the information provided on a media barcode information sheet 120 can be read as the media is pulled through the print path.

Image forming device 112 includes an interface 224 configured to couple with a communications medium (e.g., the communication media 114 of FIG. 1) for implementing communications externally of device 112 with host device 110 or other external devices. Interface 224 receives image data from the communication medium and the imaging device subsequently forms images upon print media 118 using image data received via interface 224. In one configuration, interface 224 is implemented as a JetDirect® card that is available from Hewlett-Packard Company.

Figure 3:
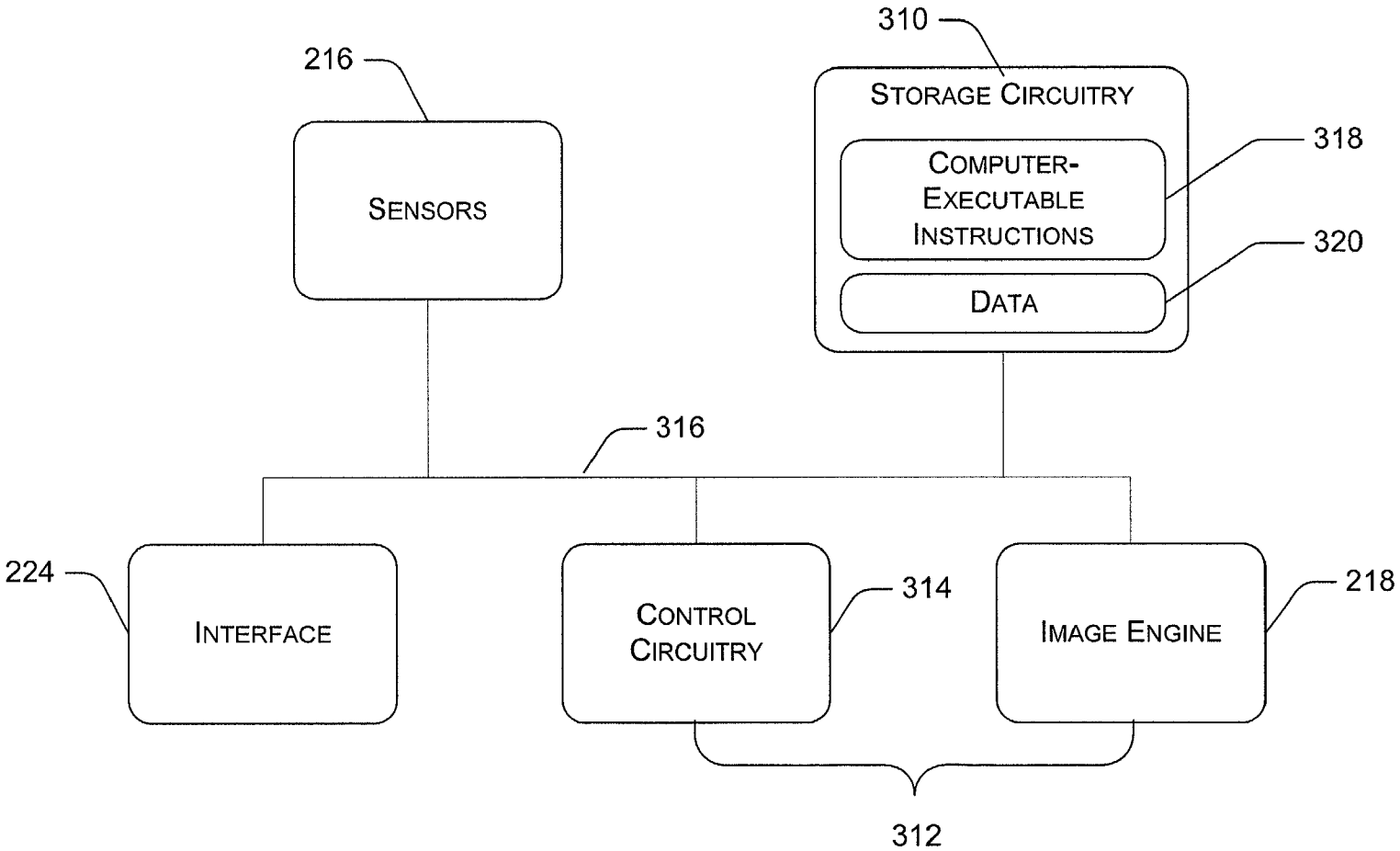
FIG. 3 shows exemplary electrical components to control operations of image forming device.

FIG. 3 is a block diagram that shows exemplary electrical components to control operations of image forming device 112. The depicted electrical circuitry includes sensors 216, interface 224, storage circuitry 310 and imaging circuitry 312 (imaging circuitry 312 includes control circuitry 314 and image engine 218 comprising assembly's 220 and 222 of FIG. 2). Further a communication medium 316 configured to implement appropriate communications is provided intermediate internal components of image forming device 112. In one arrangement, communication medium 316 is implemented as a bi-directional bus.

Storage circuitry 310 is configured to store electrical information such as image data for using and formulating hard images and instructions usable by control circuitry 314 for implementing image-forming operations within device 112. Exemplary storage circuitry includes nonvolatile memory (e.g., flash memory, EEPROM, and/or read-only memory (ROM)), random access memory (RAM), and hard disk and associated drive circuitry.

Control circuitry 314 implements processing of image data (e.g., rasterization) received via interface 224. Further, control circuitry 314 of imaging circuitry 312 performs functions with respect to the formation of images including controlling operations of image engine 218 including developing assembly 220 and fusing assembly 222 in the described configuration. For example, control circuitry 314 obtains data via appropriate signals from one or more of sensors 216 and adjusts imaging parameters of image engine 218 during formation of images.

An exemplary configuration of control circuitry 314 is implemented as a processor such as a dedicated microprocessor configured to fetch and execute computer-executable instructions 318 that are stored in storage circuitry 310. The control circuitry is also configured to fetch data 320 from the storage circuitry during the execution of the computer-executable instructions. The computer-executable instructions configure the image-forming device 112 according to the type of print media 118 being imaged upon.

For example, different types of media 118 have various weights, surface finishes, roughness, wicking properties, etc., which impact equality of images formed thereupon. The imaging parameters of device 112 including those of image engine 218 are adjusted by the control circuitry 314 in conjunction with the computer-executable instructions 318 to optimize the formation of quality images upon media 118 responsive to the types of media utilized as indicated by the data imprinted on a media barcode ID sheet 120 of FIG. 1.

In one configuration, storage circuitry 310 is configured to store a plurality of settings for one or more imaging parameters corresponding to a plurality of respective media types. Such settings are identified, for example, in a lookup table within data 320. Upon identification of a media barcode ID sheet (i.e., sheet 120 of FIG. 4) by a sensor 216, the appropriate media parameters are obtained by control circuitry 314 for configuring device 112. The parameters settings may be used directly to configure device 112 or for providing initial settings which may be subsequently modified based on other information to optimize imaging.

Exemplary Barcode Media Identification Sheet

Figure 4:
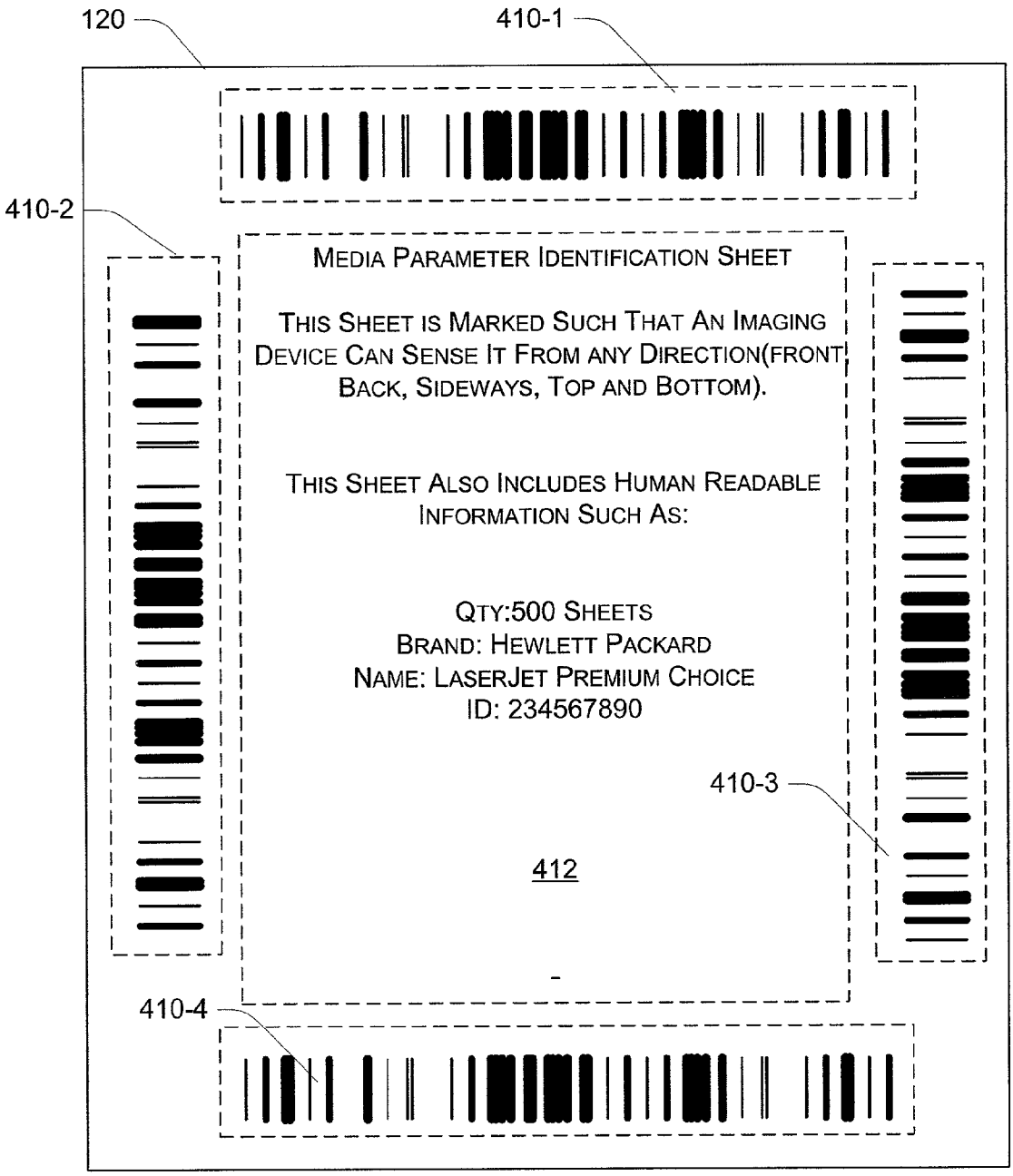
FIG. 4 shows an exemplary media barcode identification sheet.

FIG. 4 is a block diagram of an exemplary media barcode identification sheet 120. The sheet includes a number of barcode markings 410-1, 410-2, 410-3 and 410-4 encoded with media parameter information such a brand name, a media name, a media type (e.g., paper, plastic, coated, etc.), size, thickness, weight, manufacturer, media form (e.g., labels, checks, envelopes, etc.), color table, device compatibility, speed at which the media can be fed into a device, fusing temperatures, drying time, valid orientations, duplex options, temperature and humidity ranges, surface roughness, wicking, quantity/length, reorder address, and/or the like. The markings, or indicia are positioned on the media barcode ID sheet such that they can be sensed from any orientation. For example, in one implementation, the ID sheet includes markings on the front, back, on each side, and on the top and bottom.

In this configuration, the sheet 120 includes additional information such as text 412 that is human readable. The additional information allows a user to identify, for example, the media type, size, quantity of print media in a stack of media, a media identification indication, how to use the media, and so on. To illustrate information that indicates how to use the media, consider the following text: "This is an identification sheet that is automatically sensed by an imaging device to convey configuration information to the device. The device uses this information to properly print to corresponding print media.

Place this sheet on the top of the print media stack before or after loading the stack into the imaging device.

After the imaging device 112 reads the media parameter information that is on the media barcode ID sheet 120, the device moves the media ID sheet to an output bin such as the output bin 124 of FIGS. 1 and 2. There is no need for the imaging device to print on the media ID sheet.

In this manner the imaging device is able to retrieve the information from the top sheet and provide optimized printing without requiring each sheet in the stack print media stack (e.g., the stack 510 of FIG. 5) to be imprinted with information. As discussed above, this provides a substantial benefit because media upon which an image is to be formed are not marked in a fashion (e.g., marked with imprinted barcodes) that may impact print quality. Moreover, because only a single sheet in the stack is imprinted with information, rather than encoding each sheet in the stack, the described systems and procedures provide a relatively inexpensive way to present media parameters to an imaging device such as a printer, copier, facsimile, and so on.

Figure 5:
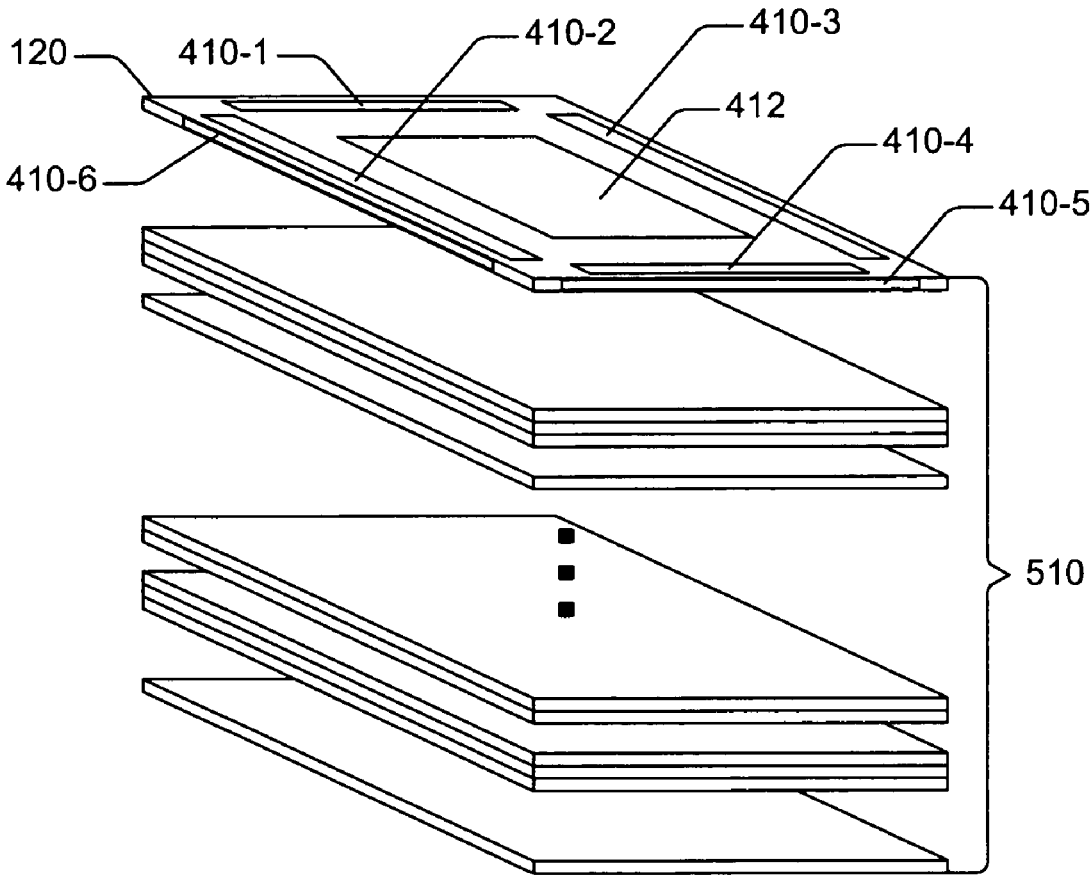
FIG. 5 shows a stack of print media, wherein a first or top media sheet in the stack is the media barcode ID sheet that can be sensed by an imaging device to configure it to form images on the remaining sheets in the stack.

FIG. 5 shows a stack of print media 510, wherein a first, or top media sheet in the stack is a media barcode ID sheet 120 that is sensed by an imaging device 112. A sensor (i.e., a sensor 216 of FIG. 2) that is optimally positioned to sense the information that is on the sheet reads the information as the imaging device removes the media barcode ID sheet from the top of the stack, The imaging device uses this sensed information to configure itself to form images on the print media.

As shown, the top sheet 120 has information on the front face (i.e., markings 410-1 through 410-4), bottom side 410-5, and left side (i.e., marking 410-6). Although not explicitly shown, the top sheet also has markings on a bottom face, a right side, and a top side. These markings are identical to the illustrated markings except with respect to their relative positions on the bottom face, right side, and/or top side. Thus, the identification sheet is marked in a fashion that allows a sensor to read the markings from any orientation (front, back, sideways, top and bottom).

Figure 6:
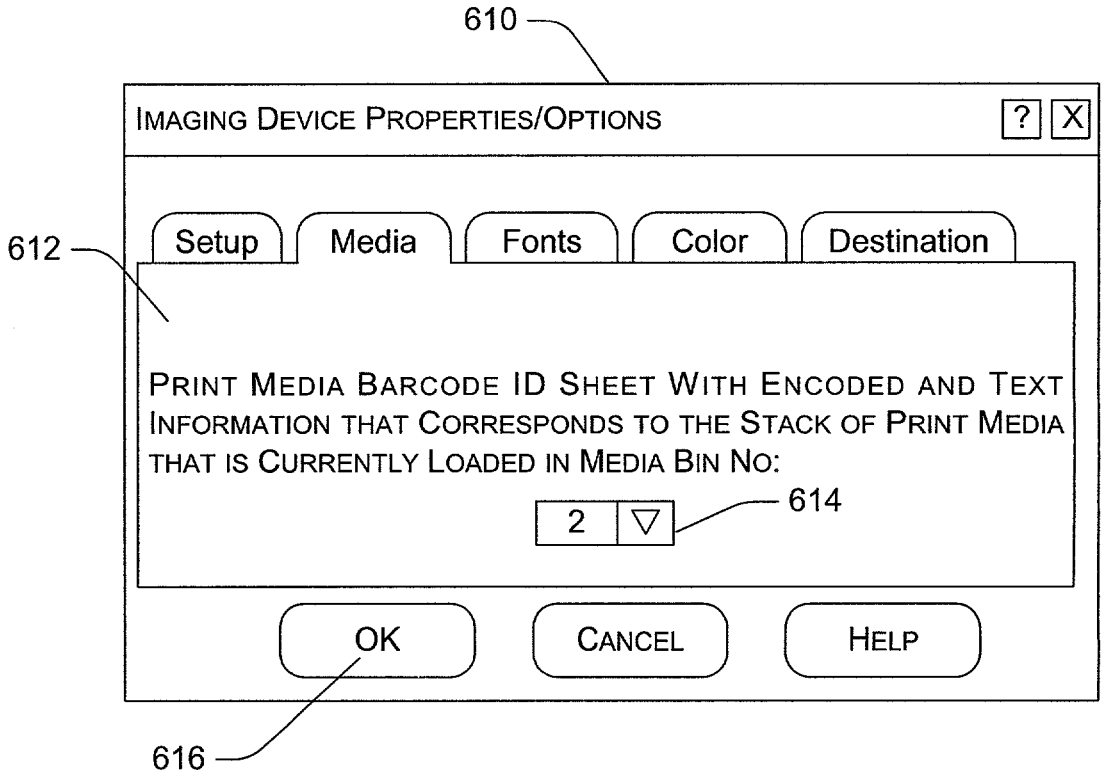
FIG. 6 shows an exemplary user interface for a user to print a new media barcode identification sheet. Specifically, the user utilizes the user interface to initiate a request for an imaging device to generate and print the new media ID sheet corresponding to a stack of print media.

FIG. 6 is a block diagram of an exemplary dialog box 610 that provides a user interface for a user to print a new media barcode identification sheet 120. Specifically, the user utilizes the dialog box to initiate a request for an imaging device 112 to generate and print the new media ID sheet corresponding to a stack of print media. The newly generated sheet can be placed onto the top of the stack of print media regardless of whether the stack is new or partially used.

The information on the new media identification sheet 120 corresponds to any remaining print media loaded in a specified or a default media supply bin 122 of the imaging device 112. Such information includes, for example, a quantity value that indicates a remaining number of sheets in the stack of print media, the type of print media (e.g., paper, transparencies, etc.), and so on. Such a quantity remaining value is calculated by the imaging device in response to: (a) reading a value that indicates a initial quantity of print media in a stack from an initial media information sheet 120, (b) storing the value in a memory such as storage circuitry 310 of FIG. 3, and (c) decrementing the stored value by one (1) each time that the device removes a sheet of print media from the stack.

Accordingly, if a user desires to temporarily remove a stack of print media (e.g., a partially used stack) from an imaging device 112, a newly generated media ID sheet 120 that corresponds to the remaining print media in the stack can be placed on the top of the removed stack for subsequent reading (i.e., if the removed stack is re-loaded into an imaging device 112). Thus, stacks of print media can be temporarily removed from an imaging device, transferred to other devices, etc., in a manner that allows an imaging device to sense media parameter information corresponding to the print media regardless of whether the print media is part of a new or a partially used stack.

The dialog box 610 may be provided by an operating system (not shown) and/or by a device driver (not shown) that is loaded on the computer 110 of FIG. 1. The device driver controls operations/communications between the computer 110 and the imaging device 112. The dialog box includes a print media tab window 612 with a dropdown menu 614 that allows the user to select a particular media supply bin (e.g., tray 120 of FIG. 1) for the imaging device to use to determine the information to be on the new ID sheet. If the user selects the "OK" button 616, the device driver will print a media barcode ID sheet that corresponds to the indicated media bin, which may be a default media bin.

The imaging device 112 of FIGS. 1 and 2 may include a user interface (UI) 126 such as a Liquid Crystal Display (LCD) on the face of the imaging device for a user to print a media barcode identification sheet 120. The display may be either touch sensitive and/or controlled by one or more input controls 128 (e.g., one or more input buttons) on the face of the device to allow a user to navigate the device's UI. The UI provides the user with means to optionally select a media bin for the imaging device to use to determine the information to be on the new ID sheet.

The imaging device 112 of FIGS. 1 through 3 may include an embedded Web server (shown as the computer-executable instructions of the storage circuitry 310) to communicate a preferences/options Web page to the computer 110. The Web page includes a UI that provides a user with an option to print a new media ID sheet as discussed above with respect to the dialog box 610. The embedded Web server uses an appropriate network transfer protocol such as the Hypertext Transfer Protocol (HTTP) to both serve Web page documents to the remote computer, and to receive Web page documents from the remote computer.

To communicate a Web page to the computer 110 of FIG. 1, the imaging device uses an Internet Protocol (IP) address or a Universal Resource Locator (URL) that substantially uniquely identifies the computer across a network such as the Internet. The computer includes a browser such as the Microsoft Internet Explorer® browser to display the communicated Web page to a user and to allow the user to communicate a Web page request to the imaging device to generate a new media barcode ID sheet 120.

Exemplary Procedure Using Media Parameter Barcode Sheet

Figure 7:
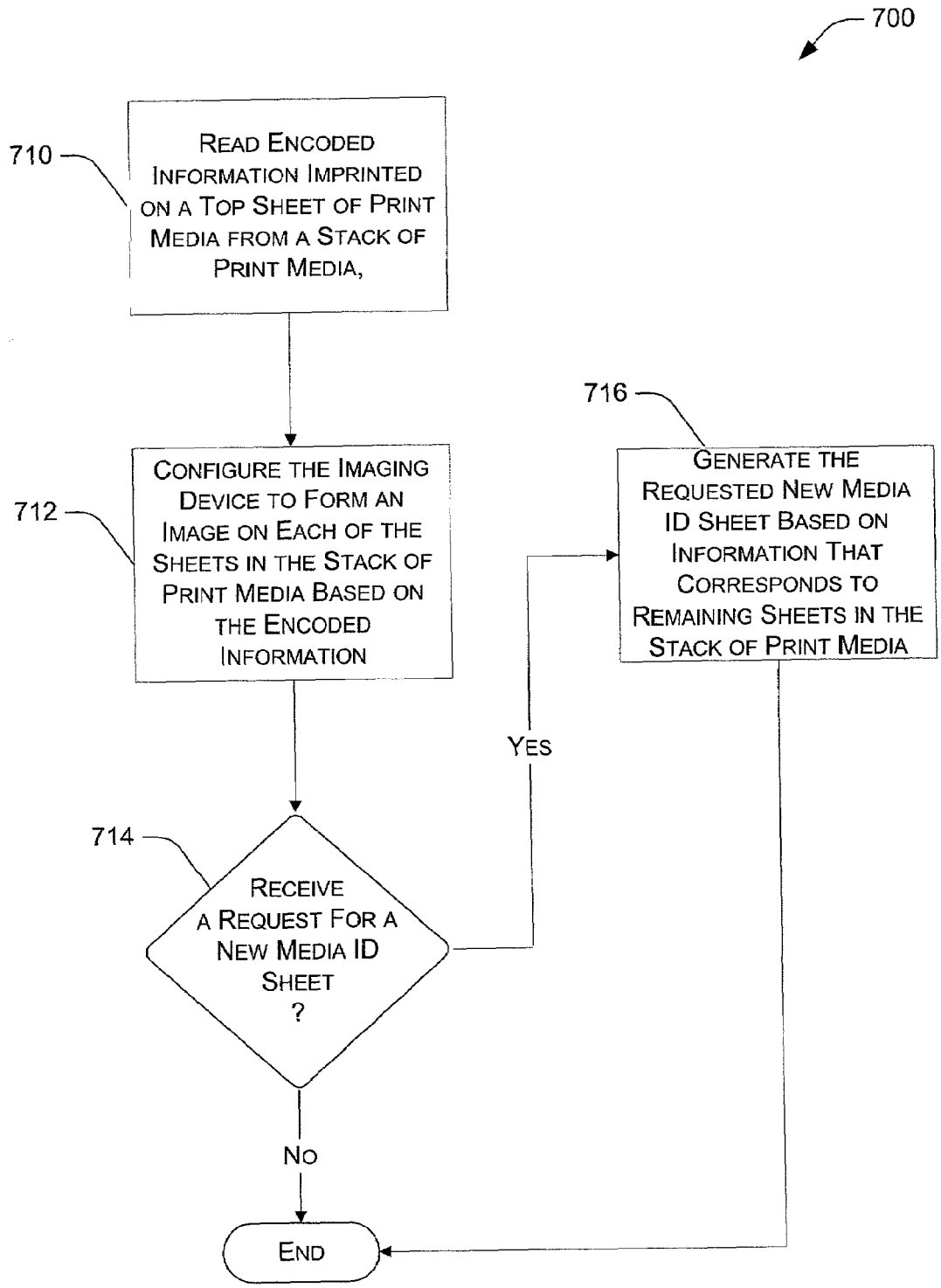
FIG. 7 shows an exemplary procedure to optimize imaging device operations based on print media information.

FIG. 7 shows an exemplary procedure 700 to optimize imaging device operations based on print media information. At block 710, an imaging device reads information imprinted on a top sheet of a stack of print media. The information on the top sheet is imprinted such that the imaging device senses the information from the top sheet independent of any particular orientation of the top sheet. The sensed information provides media parameter information that corresponds to each of the other sheets of print media in the stack of print media.

At block 712, the imaging device uses the sensed information to configure image-forming operations on respective sheets of the loaded print media.

At block 714, the imaging device determines if it has received a request to print a new media barcode identification sheet (e.g., a media sheet 120 of FIGS. 1, 4, and 5). If a request to print a new media identification sheet has not been received, the procedure 700 ends. Otherwise, at block 716, the imaging device generates the requested media barcode identification sheet. The information that is imprinted on the new sheet corresponds to any remaining print media loaded in a specified or a default media supply bin of the imaging device. Such information includes, for example, a quantity value that indicates a remaining number of sheets in the stack of print media, the type of print media (e.g., paper, transparencies, etc.), and so on.

Conclusion

Although the subject matter has been described in language specific to structural features and/or methodological operations, the subject matter defined in the appended claims is not necessarily limited to the specific features or operations described. Rather, the specific features and operations are disclosed as preferred forms of implementing the claimed subject matter.

What is claimed is:

1. A stack of print media comprising a print medium positioned on top of one or more different print media, the print medium having a set of media parameter information imprinted thereon, the media parameter information for configuring an image forming device to form an image on the one or more different print media.

2. A stack of print media as recited in claim 1, wherein the media parameter information is imprinted on the print medium such that the image forming device can sense the media parameter information independent of an orientation of the print medium in the image forming device.

3. A stack of print media as recited in claim 1, wherein the media parameter information is imprinted on the print medium on the front, back, top, bottom or sides of the print medium.

4. A stack of print media as recited in claim 1, wherein the print medium further comprises human readable instructions indicating how to use the print medium to configure the image forming device to form images on each of the one or more different print media.

5. In an imaging device loaded with a stack of print media comprising a top sheet and a plurality of other sheets of print media, a method for automatically configuring the imaging device to form images each of the other sheets of print media, the method comprising:

reading information from the top sheet, the information providing a set of media parameter information corresponding to each of the other sheets; and configuring the imaging device to form images on each of the other sheets based on the information.

6. A method as recited in claim 5, wherein the information is imprinted on the top sheet such that the imaging device senses the encoded information independent of any particular orientation of the top sheet.

7. A method as recited in claim 5, wherein the information is a barcode that is imprinted on the front, back, top, bottom and/or sides of the top sheet.

8. A method as recited in claim 5, wherein the top sheet further comprises human readable information that provides instructions to a user on how to use the top sheet to configure the imaging device to form images on each of the other sheets.

9. A method as recited in claim 5, wherein reading information from the top sheet further comprises detecting a quantity of print media in the stack of print media from the information.

10. A method as recited in claim 5, wherein the stack of print media is loaded into a media supply bin that is coupled to the imaging device, and wherein the method further comprises:

removing, by the imaging device, one or more of the other sheets from the media supply bin;

receiving a request to generate a new media identification sheet; and responsive to receiving the request, generating the new media identification sheet comprising one or more new media parameters that correspond to each of the other sheets of print media remaining in the media supply bin.

11. A method as recited in claim 10, wherein the new media parameters comprise an indication of a quantity of print media remaining in the stack of print media.

12. A computer-readable medium comprising computer-executable instructions for automatically configuring an imaging device to form images on a plurality of sheets of print media in a stack of print media, the computer-executable instructions comprising instructions for:

reading information from a top sheet of the stack of print media, the information providing a set of media parameter information corresponding to each of the sheets of print media independent of the top sheet; and configuring the imaging device to form images on each of the sheets of print media based on the information.

13. A computer-readable medium as recited in claim 12, wherein the information is imprinted on the top sheet such that the imaging device senses the information independent of any particular orientation of the top sheet.

14. A computer-readable medium as recited in claim 12, wherein the information is a barcode that is imprinted on the front, back, top, bottom and/or sides of the top sheet.

15. A computer-readable medium as recited in claim 12, wherein the top sheet further comprises human readable information that provides instructions to a user on how to use the top sheet to configure the imaging device to form images on each of the other sheets.

16. A computer-readable medium as recited in claim 12, wherein reading information from the top sheet further comprises detecting a quantity of print media in the stack of print media from the information.

17. A computer-readable medium as recited in claim 12, wherein the stack of print media is loaded into a media supply bin that is coupled to the imaging device, and wherein the computer-executable instructions further comprise instructions for:

removing one or more of the sheets of print media from the media supply bin;

receiving a request to generate a new media identification sheet; and responsive to receiving the request, generating the new media identification sheet comprising one or more new media parameters that correspond to each of the sheets of print media that remaining in the media supply bin.

18. A computer-readable medium as recited in claim 17, wherein the new media parameters comprise an indication of a quantity of print media remaining in the stack of print media.

19. An imaging device comprising:

a memory comprising computer-executable instructions for automatically configuring the imaging device to form images on a plurality of sheets of print media in a stack of print media that is loaded in a media supply bin;

a processor that is operatively coupled to the memory, the processor being configured to fetch and execute the computer-executable instructions from the memory, the computer-executable instructions comprising instructions for:

reading information from a top sheet of the stack of print media, the information providing a set of media parameter information corresponding to each of the sheets of print media independent of the top sheet; and configuring the imaging device form images on each of the sheets of print media based on the information.

20. An imaging device as recited in claim 19, wherein the information is imprinted on the top sheet such that the imaging device senses the information independent of any particular orientation of the top sheet.

21. An imaging device as recited in claim 19, wherein the information is a barcode that is imprinted on the front, back, top, bottom and/or sides of the top sheet.

22. An imaging device as recited in claim 19, wherein the top sheet further comprises human readable information that provides instructions to a user on how to use the top sheet to configure the imaging device to form images on each of the other sheets.

23. An imaging device as recited in claim 19, wherein reading information from the top sheet further comprises detecting a quantity of print media in the stack of print media from the information.

24. An imaging device as recited in claim 19, wherein the computer-executable instructions further comprise instructions for:

removing one or more of the sheets of print media from the media supply bin;

receiving a request to generate a new media identification sheet; and responsive to receiving the request, generating the new media identification sheet comprising one or more new media parameters that correspond to each of the sheets of print media that remaining in the media supply bin.

25. An imaging device as recited in claim 24, wherein the new media parameters comprise an indication of a quantity of print media remaining in the stack of print media.

* * * * *

UNITED STATES PATENT AND TRADEMARK OFFICE

CERTIFICATE OF CORRECTION

PATENT NO. : 6,985,682 B2
APPLICATION NO. : 09/981265
DATED : January 10, 2006
INVENTOR(S) : Robert B. Haines et al.

It is certified that error appears in the above-identified patent and that said Letters Patent is hereby corrected as shown below:

On the Title page, in Item (73), in "Assignee", in column 1, line 2, delete "LP.," and insert -- L.P., --, therefor.

On the Title page, in Item (57), under "Abstract", in column 2, line 10, after "configured" insert -- to --.

In column 9, line 8, in Claim 6, delete "encoded" before "information".

In column 10, line 11, in Claim 17, after "media" delete "that".

In column 10, line 32, in Claim 19, after "device" insert -- to --.

In column 10, line 61, in Claim 24, after "media" delete "that".

Signed and Sealed this

Seventh Day of July, 2009

JOHN DOLL
*Acting Director of the United States Patent and Trademark Office*